US008590315B2

(12) United States Patent
Overby et al.

(10) Patent No.: US 8,590,315 B2
(45) Date of Patent: Nov. 26, 2013

(54) EXTRUDED FLUID MANIFOLD FOR GAS TURBOMACHINE COMBUSTOR CASING

(75) Inventors: Brandon Taylor Overby, Greenville, SC (US); Jason Allen Seale, Simpsonville, SC (US); Ibrahim Ucok, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 742 days.

(21) Appl. No.: 12/791,341

(22) Filed: Jun. 1, 2010

(65) Prior Publication Data

US 2011/0289926 A1 Dec. 1, 2011

(51) Int. Cl.
*F02C 1/00* (2006.01)

(52) U.S. Cl.
USPC ..... 60/752

(58) Field of Classification Search
USPC ..... 60/734, 739, 791, 798, 796, 730, 60/752–760, 797, 790, 800; 29/889.22, 29/889.3, 469
See application file for complete search history.

(56) References Cited

U.S. PATENT DOCUMENTS 3,705,492 A * 12/1972 Vickers ..... 60/39.511
5,231,833 A * 8/1993 MacLean et al. ..... 60/734
6,173,561 B1 * 1/2001 Sato et al. ..... 60/772
6,513,334 B2 * 2/2003 Varney ..... 60/776
8,234,873 B2 * 8/2012 Houtman et al. ..... 60/739
2001/0020364 A1 * 9/2001 Sato et al. ..... 60/746
2003/0182945 A1 * 10/2003 Runkle et al. ..... 60/776
2008/0072599 A1 * 3/2008 Morenko et al. ..... 60/734
2010/0071376 A1 * 3/2010 Wiebe et al. ..... 60/740

OTHER PUBLICATIONS

National Supply Source Stainless Steel Data, Aug. 2006, p. 5 http://web.archive.org/web/20060810112551/http://www.nolansupply.com/stainlessgrades.htm[Feb. 4, 2013 4:06:58 PM].*

* cited by examiner

*Primary Examiner* — Phutthiwat Wongwian
*Assistant Examiner* — William Breazeal
(74) *Attorney, Agent, or Firm* — Cantor Colburn LLP

(57) ABSTRACT

A turbomachine includes a compressor, a turbine, and a combustor operatively coupled to the compressor and the turbine. The combustor includes a combustor casing having a flange, an outer surface and an inner surface that defines an internal passage. The combustor casing includes an extruded fluid manifold mounted to the outer surface. The extruded fluid manifold includes first and second walls integrally formed with a third, connecting, wall. The first wall includes a first mounting element and the second wall includes a second mounting element. The first mounting element extends axially along the combustor casing away from the first wall and the second mounting element extends axially along the combustor casing away from the second wall and the first mounting element. The extruded fluid manifold is joined to the outer surface of the combustor casing through the first and second mounting elements.

17 Claims, 6 Drawing Sheets

EXTRUDED FLUID MANIFOLD FOR GAS TURBOMACHINE COMBUSTOR CASING

BACKGROUND OF THE INVENTION

The subject matter disclosed herein relates to the art of turbomachines and, more particularly, to an extruded fuel manifold for a gas turbomachine combustor casing.

In conventional turbomachines, a first fluid, such as fuel, is directed into a combustor casing prior to being mixed with another fluid, such as air, and ignited to form hot gases. The first fluid enters the combustor casing through a fuel manifold. The fuel manifold extends about, and is joined to, the combustor casing. The fuel manifold is formed by joining three strips of material to form an inverted U-shaped structure having one open end. The open end is then placed over fuel inlets provided in the combustor casing. At this point, the fuel manifold is joined to the combustor casing by welding. Fluid is then introduced into the fuel manifold and directed into the combustor casing via the fuel inlets.

BRIEF DESCRIPTION OF THE INVENTION

According to one aspect of the invention, a turbomachine includes a compressor, a turbine, and a combustor operatively coupled to the compressor and the turbine. The combustor includes a combustor casing having a flange, an outer surface and an inner surface that defines an internal passage. The combustor casing includes an extruded fluid manifold mounted to the outer surface. The extruded fluid manifold includes first and second walls integrally formed with a third, connecting, wall. The first wall includes a first mounting element and the second wall includes a second mounting element. The first mounting element extends axially along the combustor casing away from the first wall and the second mounting element extends axially along the combustor casing away from the second wall and the first mounting element. The extruded fluid manifold is joined to the outer surface of the combustor casing through the first and second mounting elements. The extruded fluid manifold defines a fluid plenum that extends radially about the combustor casing.

According to another aspect of the invention, a turbomachine combustor casing includes a flange, an outer surface and an inner surface that defines an internal passage. The combustor casing also includes an extruded fluid manifold mounted to the outer surface. The extruded fluid manifold includes first and second walls integrally formed with a third, connecting, wall. The first wall includes a first mounting element and the second wall includes a second mounting element. The first mounting element extends axially along the combustor casing away from the first wall and the second mounting element extends axially along the combustor casing away from the second wall and the first mounting element. The extruded fluid manifold is joined to the outer surface of the combustor casing through the first and second mounting elements. The extruded fluid manifold defines a fluid plenum that extends radially about the combustor casing.

According to yet another aspect of the invention, a method of forming a turbomachine combustor casing having an outer surface and an inner surface that defines an internal passage includes extruding a fluid manifold having first and second walls integrally formed with a third wall. A first mounting element is formed with the first wall. The first mounting element extends outward from an end portion of the first wall spaced from the third wall. A second mounting element is formed with the second wall. The second mounting element extends outward from an end portion of the second wall spaced from the third wall. The second mounting element extends in a direction opposite the first mounting element. The method also includes mounting the fluid manifold to the outer surface of the casing through the first and second mounting elements. The first, second, and third walls combining with the outer surface to form a fluid plenum.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
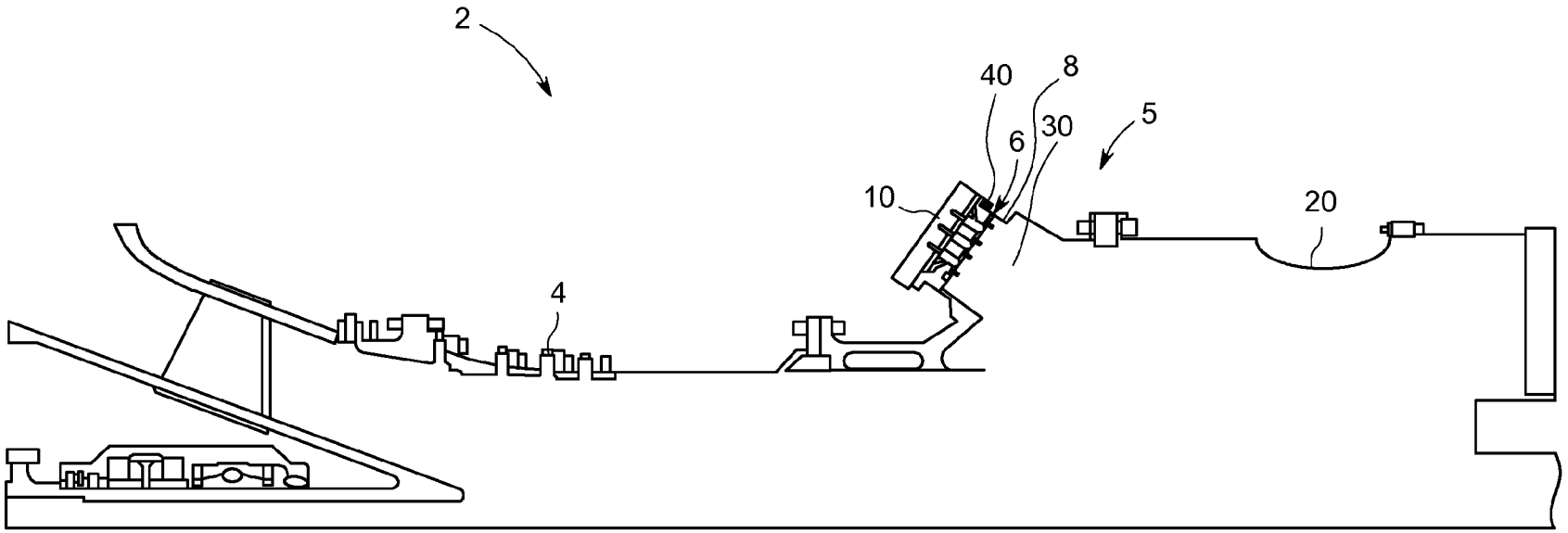
FIG. 1 is a cross-sectional side view of a turbomachine including an extruded fluid manifold in accordance with an exemplary embodiment.

With initial reference to FIG. 1, a turbomachine constructed in accordance with exemplary embodiments is indicated generally at 2. Turbomachine 2 includes a compressor 4 and a combustor assembly 5 having at least one combustor 6. Combustor 6 includes a combustor casing 8 and an end cover 10 that supports a plurality of injection nozzle assemblies (not shown). Turbomachine 2 also includes a turbine 20. In one exemplary embodiment, turbomachine 2 is a heavy duty gas turbine engine, however, it should be understood that the exemplary embodiments are not limited to any one particular engine configuration and may be used in connection with a variety of other turbomachines.

Combustor 6 is fluidly connected with compressor 4 and turbine 20. Compressor 4 delivers compressed air to combustor 6 and cooling air to various portions of turbine 20. Combustor 6 is further shown to include a combustion chamber 30 within which a fuel/air mixture is ignited to form a hot gas stream that is directed to turbine 20. The hot gas stream passes through a transition piece (not separately labeled) that fluidly couples combustor 6 to turbine 20. The transition piece channels the hot gas stream generated in combustion chamber 30 downstream towards a first stage turbine nozzle (not shown). At this point it should be understood that the above-described structure was provided for the sake of completeness and to enable a better understanding of the exemplary embodiments which are directed to an extruded fluid plenum 40 mounted to combustor casing 8.

Figure 2:
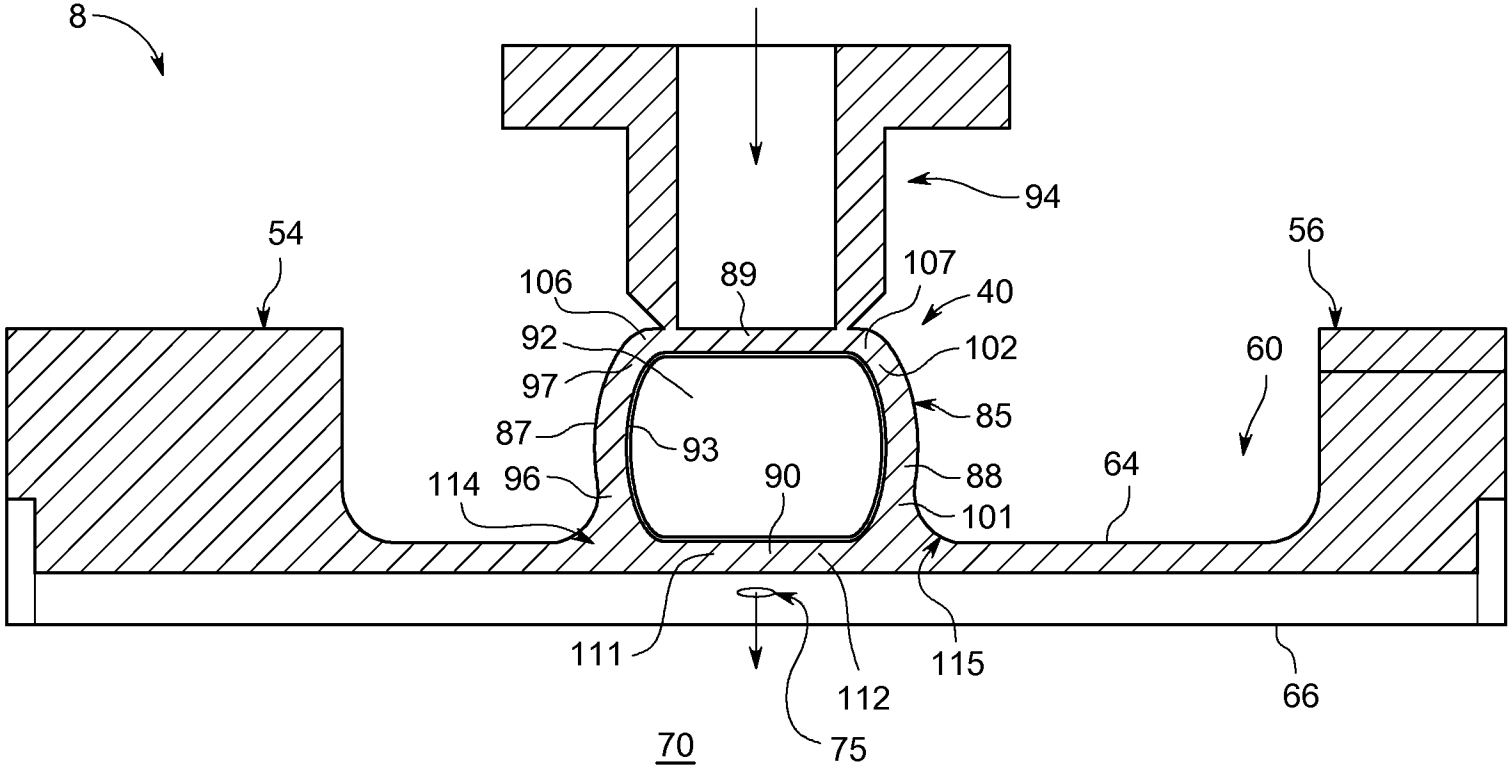
FIG. 2 is a partial cross-sectional view of the extruded fluid manifold of FIG. 1.
Figure 3:
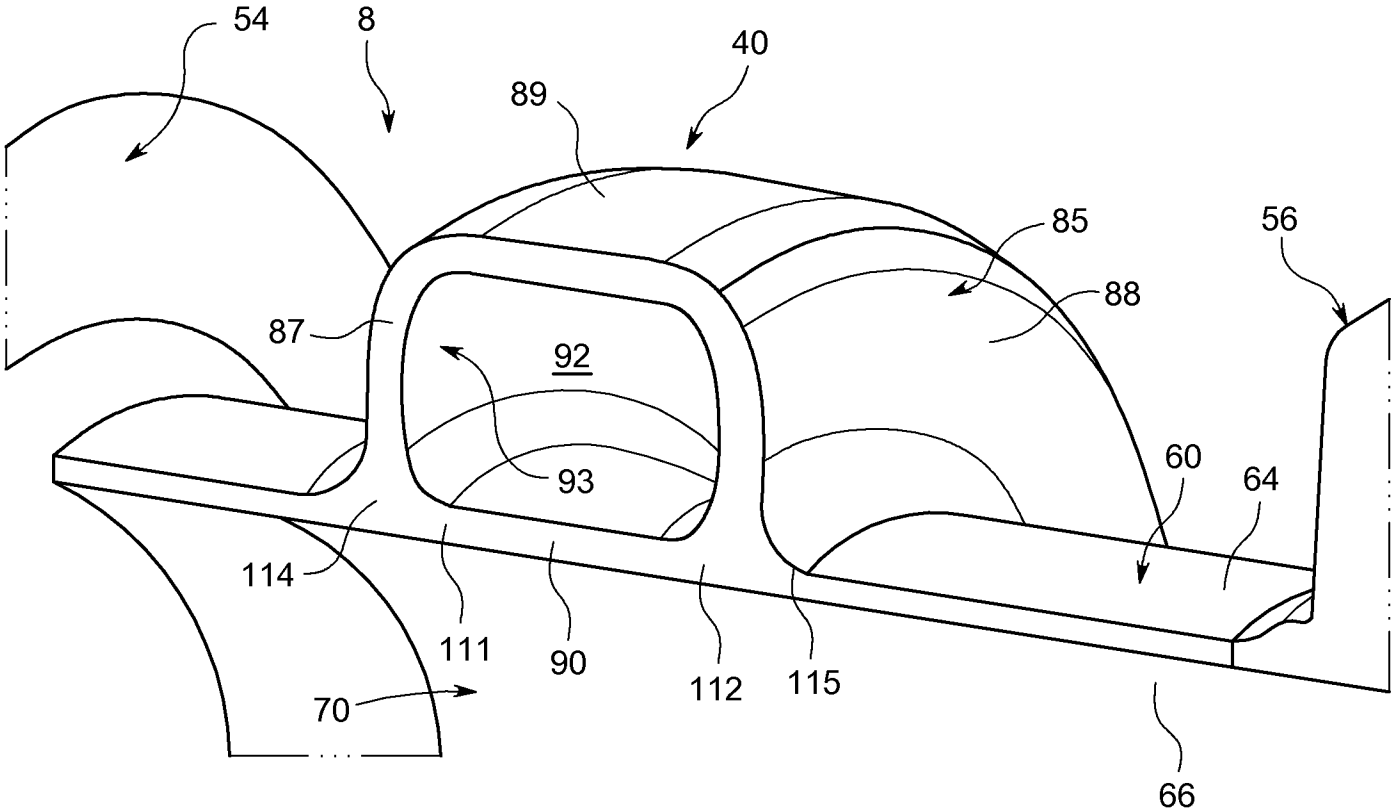
FIG. 3 is a perspective view of the extruded fluid manifold of FIG. 2.
Figure 4:
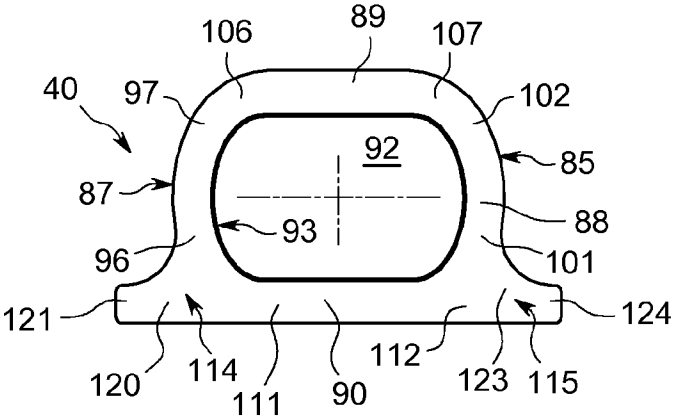
FIG. 4 is an elevational view of the extruded fluid manifold of FIG. 2.

As shown in FIGS. 2-4, combustor casing 8 includes a forward flange 54 that is connected to an aft flange 56 through a casing body 60. Casing body 60 includes an outer surface 64 and an inner surface 66 that defines an internal passage 70. A fluid passage 75 extends through casing body 60 and, as will become more fully evident below, is fluidly connected to extruded fluid manifold 40. Extruded fluid manifold 40 extends radially (See FIG. 3) about combustor casing 8 and delivers a fluid, typically fuel, to combustor 6.

Extruded fluid plenum 40 includes a body 85 having a first side wall 87 and a second side wall 88 that are extruded, together with a third wall 89 and a fourth wall 90, from a single material blank. First, second, third, and fourth walls 87-90 define a fluid plenum 92 that extends radially about combustor casing 8. Fourth wall 90 includes an opening (not shown) that registers with fluid passage 75. In accordance with one aspect of the exemplary embodiment, extruded fluid manifold 40 includes an anti-corrosive layer 93 that extends through fluid plenum 92. Anti-corrosive layer 93 is formed as an inner-surface of first, second, third, and fourth walls 87-90 to provide a barrier to fluid, such as fuels, passing through fluid plenum 92. Anti-corrosive layer 93 is formed from, for example, stainless steel or steel alloys containing chromium. Of course, other materials could also be employed depending upon the anti-corrosive properties desired for fluid plenum 92. With this arrangement, fluid, typically in the form of fuel, is passed from a fluid inlet member 94 through an opening (not shown) formed in third wall 89 into extruded fluid manifold 40. The fluid flows through fluid plenum 92 and passes into internal passage 70 through fluid passage 75.

As shown in FIG. 4, first side wall 87 includes a first end 96 that extends to a second end 97. Second side wall 88 includes a first end portion 101 that extends to a second end portion 102, and third wall 89 includes a first end section 106 that joins with second end 97 of first side wall 87 and a second end section 107 that joins with second end portion 102 of second side wall 88. Similarly, fourth wall 90 includes a first end section 111 that joins first end 96 of first side wall 87 and a second end section 112 that joins first end portion 101 of second side wall 88. In accordance with the exemplary embodiment, extruded fluid manifold 40 includes a first mounting element 114 and a second, opposing mounting element 115.

First mounting element 114 includes a first end 120 that extends from first end section 111 of fourth wall 90 to a second, cantilevered, end 121. Second mounting element 115 includes a first end 123 that extends from second end section 112 of fourth wall 90 to a second cantilevered end 124. As best shown in FIGS. 1 and 2, first mounting element 114 extends axially along casing body 60 toward forward flange 54. Second mounting element 115 extends axially along casing body 60 toward aft flange 56 and in a direction opposite to first mounting element 114. First and second mounting elements 114 and 115 provide structure that is used to secure fluid manifold 40 to combustor casing 8. Moreover, by providing structure that extends outward from first and second side walls 87 and 88, extruded manifold 40 is secured to combustor casing 8 using full penetration welds. Full penetration welds are substantially more secure than welds used in conventional manifolds. In addition, contrary to prior art arrangements, the particular design of first and second mounting elements 114 and 114 enables the use of full penetration welds at mounting elements 114 and 115 allows for full weld inspection in order to ensure proper adhesion of extruded manifold 40 to combustor casing 8.

Figure 5:
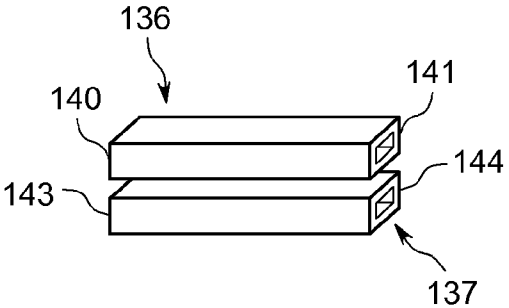
FIG. 5 is a plan view of first and second extrusions that form the extruded fluid manifold of FIG. 1.
Figure 7:
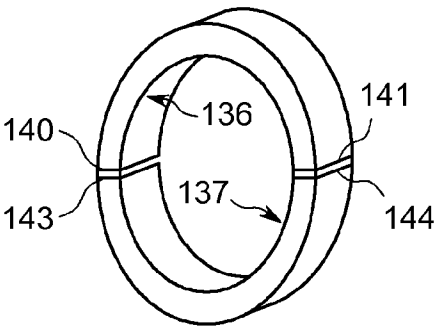
FIG. 7 is a plan view of the first and second extrusions of FIG. 6 joined to form the extruded fluid manifold of FIG. 1.
Figure 6:
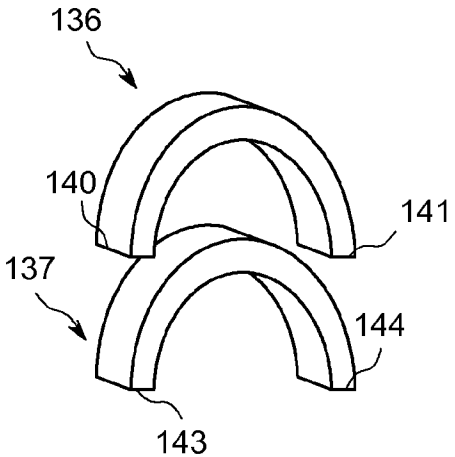
FIG. 6 is a plan view of the first and second extrusions rolled into 180° arcs.

Reference will now be made to FIGS. 5-7 in describing a method of forming extruded fluid manifold 40. Initially, first and second extrusion sections 136 and 137 are formed using conventional extrusion methods. In accordance with one aspect of an exemplary embodiment, each extrusion section 136 and 137 includes an anti-corrosive material that ultimately covers internal surfaces of walls 87-90 (FIG. 2). As shown, first extrusion section 136 includes a first end section 140 that extends along a substantially linear intermediate section (not separately labeled) to a second end section 141. Second extrusion section 137 includes a first end portion 143 that extends along a substantially linear intermediate portion (not separately labeled) to a second end portion 144 such as shown in FIG. 5. Once formed, first and second extrusion elements 136 and 137 are rolled into generally 180° arcs such as shown in FIG. 6. At this point, first and second extrusion sections 136 and 137 are joined and such as shown in FIG. 7. That is, first end section 140 of first extrusion element 136 is joined to first end portion 143 of second extrusion section 137 and second end section 141 of first extrusion section 136 is joined to second end portion 144 of second extrusion section 137. Extruded fluid manifold 40 is then secured about combustor casing 8 though a plurality of full penetration welds along first and second mounting elements 114 and 115 as discussed above.

Figure 8:
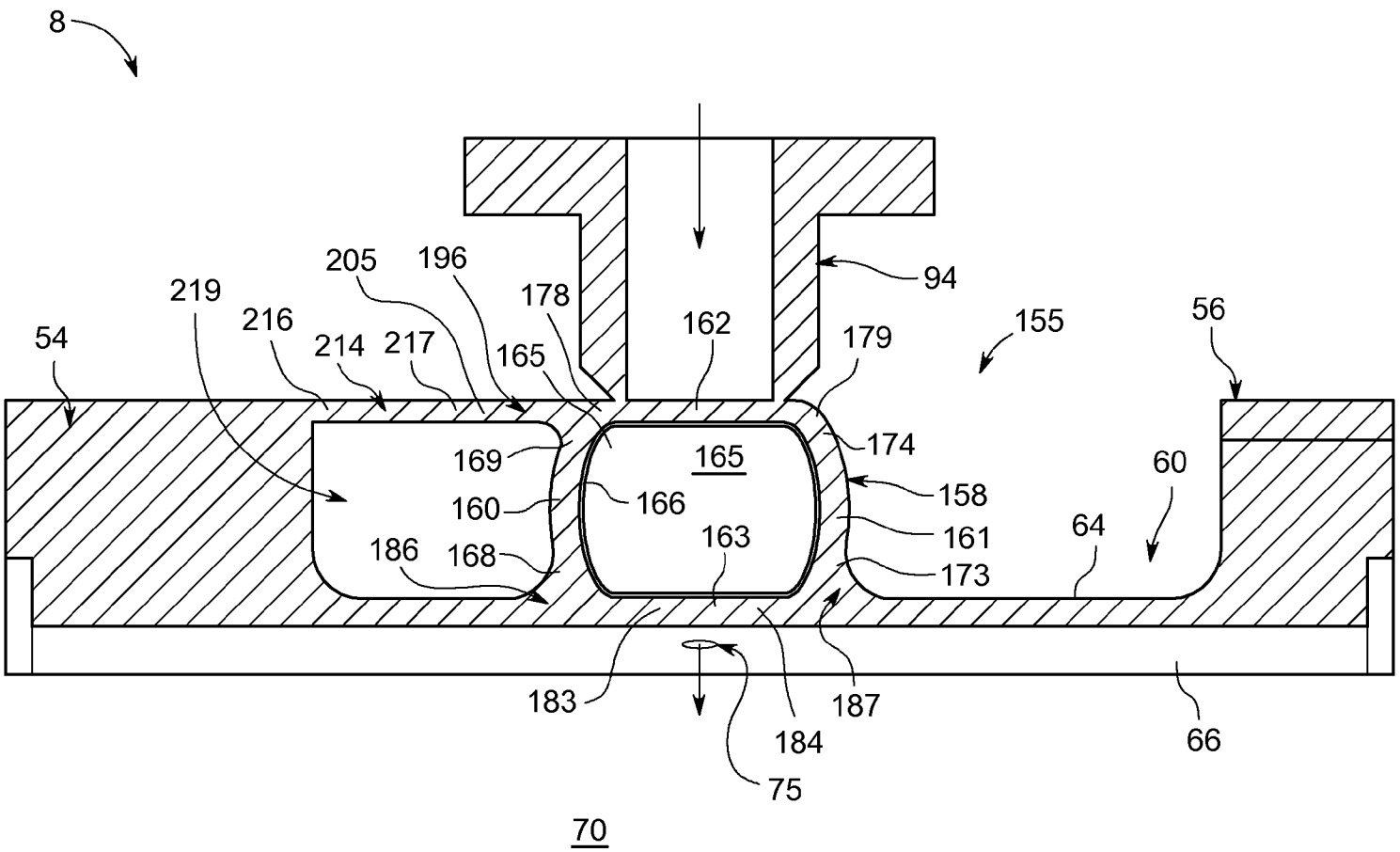
FIG. 8 is a partial cross-sectional view of an extruded fluid manifold in accordance with another aspect of the exemplary embodiment.
Figure 9:
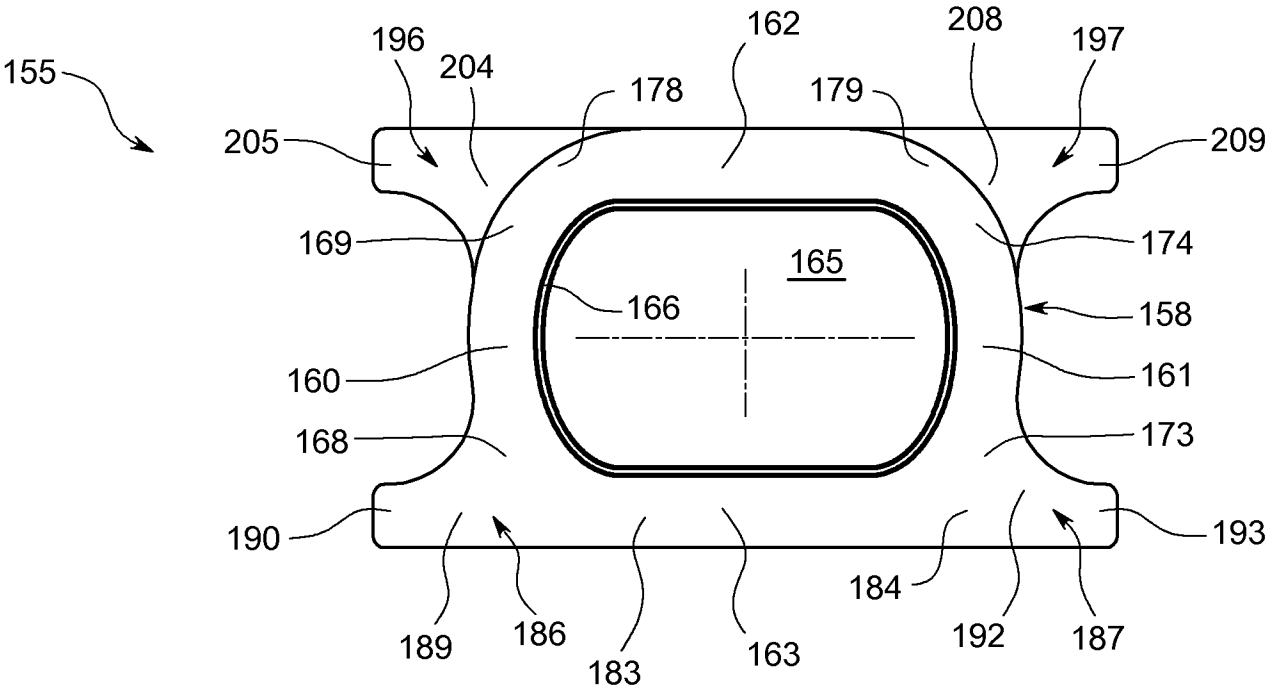
FIG. 9 is an elevational view of the extruded fluid manifold of FIG. 8.

Reference will now be made to FIGS. 8-9, wherein like reference numbers represent corresponding parts in the respective views, in describing an extruded fluid manifold 155 constructed in accordance with another aspect of the exemplary embodiment. Extruded fluid manifold 155 includes a body 158 having first and second side walls 160 and 161 that are formed together with third and fourth walls 162 and 163. First, second, third, and fourth walls 160-163 combine to define a fluid plenum 165. Fourth wall 163 includes an opening (not shown) that registers with fluid passage 75 to fluidly connected fluid plenum 165 and internal passage 70. In a manner similar to that described above, fluid plenum 165 includes an anti-corrosive layer 166 that is created when forming extruded fluid manifold 155. Anti-corrosive layer 166 is formed as an inner-surface (not separately labeled) of first, second, third, and fourth walls 160-163 to provide a barrier to fluid, such as fuels, passing through fluid plenum 165. Anti-corrosive layer 166 is formed from, for example, stainless steel or steel alloys containing chromium. Of course, other materials could also be employed depending upon the anti-corrosive properties desired for fluid plenum 165. With this arrangement, fluid, typically in the form of fuel, is passed into extruded fluid manifold 155 via fluid inlet member 94. The fluid flows through fluid plenum 165 and passes into internal passage 70 through fluid passage 75.

As shown, first side wall 160 includes a first end 168 that extends to a second end 169. Second side wall 161 includes a first end portion 173 that extends to a second end portion 174, and third wall 162 includes a first end section 178 that joins with second end 169 of first side wall 160 and a second end section 179 that joins with second end portion 174 of second side wall 161. Similarly, fourth wall 163 includes a first end section 183 that joins first end 168 of first side wall 160 and a second end section 184 that joins first end portion 173 of second side wall 161. In accordance with the exemplary embodiment, extruded fluid manifold 155 includes a first mounting element 186 and a second, opposing mounting element 187.

First mounting element 186 includes a first end 189 that extends from first end section 183 of fourth wall 163 to a second end 190. Second mounting element 187 includes a first end 192 that extends from second end section 184 of fourth wall 163 to a second end 193. As best shown in FIG. 8, first mounting element 186 extends axially along casing body 60 toward forward flange 54. Second mounting element 187 extends axially along casing body 60 toward aft flange 56 in a direction opposite to first mounting element 186. First and second mounting elements 186 and 187 provide structure used to secure fluid manifold 155 to combustor casing 8. Moreover, by providing structure that extends outward from first and second side walls 160 and 161, extruded manifold 155 is secured to combustor casing 8 using full penetration welds. Full penetration welds are substantially more secure than welds used in securing conventional manifolds. In addition, contrary to prior art arrangements, the particular design of mounting elements 186 and 187 allow for full inspection of the welds in order to ensure proper adhesion of extruded manifold 155 to casing 8.

In further accordance with the exemplary embodiment shown, extruded fluid manifold 155 also includes a first mounting member 196 and a second mounting member 197. First mounting member 196 includes a first end portion 204 that extends from first end section 178 of third wall 162 to a second, cantilevered portion 205. Similarly, second mounting member 197 includes a first end portion 208 that extends from second end section 179 of third wall 162 to a second, cantilevered portion 209. Once installed, often times second mounting member 197 is removed such as shown in FIG. 8 leaving behind only mounting member 196. With this arrangement, a bridge member 214 is secured between second end portion 205 of first mounting member 196 and first flange 54. More specifically, bridge member 214 includes a first end section 216 that joins with first flange 54 and a second end section 217 that joins with first end section 178 of third wall 162 to form a passage 219. Passage 219 is employed to, for example, transport steam through combustor casing 8. With this arrangement, extruded fluid plenum 155 not only defines fluid plenum 165 but also provides structure to establish passage 219.

At this point it should be understood that the above described exemplary embodiments provide a fluid plenum that can be employed for the transport of fluid in the form of air, fuel or diluents about the combustor casing. By forming the manifold with an internal, anti-corrosive layer, corrosive fluids, such as fuels will not erode or damage the internal surfaces. In addition, the use of mounting elements that extend outward from the side walls, extrude fuel plenum can be mounted to the combustor casing using fully inspectable, full penetration welds. Finally, the use of an extrusion process to form the fluid plenum reduces the over all number of connections/joints that could fail over time.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A turbomachine comprising:

a compressor;

a turbine; and a combustor operatively coupled to the compressor and the turbine, the combustor including a combustor casing having a flange, an outer surface and an inner surface that defines an internal passage, the flange extending radially outwardly from the outer surface of the casing, the combustor casing including an extruded fuel manifold mounted to the outer surface, the extruded fuel manifold including first and second walls integrally formed with a third, connecting, wall, the first wall including a first mounting element and the second wall including a second mounting element, the first mounting element extending axially along the combustor casing away from the first wall and the second mounting element extending axially along the combustor casing away from the second wall and the first mounting element, the extruded fuel manifold being joined to the outer surface of the combustor casing through the first and second mounting elements, the extruded fuel manifold defining a fluid plenum that extends radially about the combustor casing, wherein the extruded fuel manifold includes an anti-corrosive layer that is non-reactive with fuel.

2. The turbomachine according to claim 1, wherein the anti-corrosive layer comprises stainless steel.

3. The turbomachine according to claim 1, wherein the anti-corrosive layer comprises a steel alloy including chromium.

4. The turbomachine according to claim 1, wherein the extruded fuel manifold includes at least one mounting member, the at least one mounting member extending axially outward from one of the first and second walls at the third wall.

5. The turbomachine according to claim 4, wherein the at least one mounting member is substantially co-planar with the third wall.

6. The turbomachine according to claim 4, further comprising: a bridge member extending between the at least one mounting member and the flange, the bridge member, defining, at least in part, a passage that extends about the combustor casing.

7. The turbomachine according to claim 1, wherein the extruded fuel manifold includes a first extrusion section and a second extrusion section, the first extrusion section being joined to the second extrusion section to form the extruded fluid manifold.

8. The turbomachine according to claim 1, further comprising: at least one fluid passage formed in the combustor casing, the at least one fluid passage fluidly coupling the fluid plenum and the internal passage.

9. The turbomachine according to claim 1, further comprising: a fuel inlet member mounted to the extruded fuel manifold, the fuel inlet member being fluidly connected to the fluid plenum.

10. A turbomachine combustor casing comprising:

a flange, an outer surface and an inner surface that defines an internal passage, the flange extending radially outwardly from the outer surface of the casing; and an extruded fuel manifold mounted to the outer surface, the extruded fuel manifold including first and second walls integrally formed with a third, connecting, wall, the first wall including a first mounting element and the second wall including a second mounting element, the first mounting element extending axially along the combustor casing away from the first wall and the second mounting element extending axially along the combustor casing away from the second wall and the first mounting element, the extruded fuel manifold being joined to the outer surface of the combustor casing through the first and second mounting elements, the extruded fuel manifold defining a fuel plenum that extends radially about the combustor casing, wherein the extruded fuel manifold includes an anti-corrosive layer that is non-reactive with fuel.

11. The turbomachine combustor casing according to claim 10, wherein the anti-corrosive layer comprises at least one of stainless and a steel alloy including chromium.

12. The turbomachine combustor casing according to claim 10, wherein the extruded fuel manifold includes at least one mounting member, the at least one mounting member extending axially outward from one of the first and second walls at the third wall.

13. The turbomachine combustor casing according to claim 12, wherein the at least one mounting member is substantially co-planar with the third wall.

14. The turbomachine combustor casing according to claim 12, further comprising: a bridge member extending between the at least one mounting member and the flange, the bridge member, defining, at least in part, a passage that extends about the combustor casing.

15. The turbomachine combustor casing according to claim 10, wherein the extruded fuel manifold includes a first extrusion section and a second extrusion section, the first extrusion section being joined to the second extrusion section to form the extruded fuel manifold.

16. The turbomachine combustor casing according to claim 10, further comprising: at least one fluid passage formed in the combustor casing, the at least one fluid passage fluidly coupling the fuel plenum and the internal passage.

17. A method of forming a turbomachine combustor casing having an outer surface and an inner surface that defines an internal passage, a flange extending radially outwardly from the outer surface of the casing, the method comprising:

extruding a fuel manifold having first and second walls integrally formed with a third wall, each of the first, second and third walls including an anti-corrosive layer, wherein a first mounting element is formed with the first wall, the first mounting element extending outward from an end portion of the first wall spaced from the third wall, and a second mounting element is formed with the second wall, the second mounting element extending outward from an end portion of the second wall spaced from the third wall, the second mounting element extending in a direction opposite the first mounting element; and mounting the fuel manifold to the outer surface of the casing through the first and second mounting elements, the first, second, and third walls forming a fuel plenum.

* * * * *